US011096459B2

(12) United States Patent
Scott

(10) Patent No.: US 11,096,459 B2
(45) Date of Patent: Aug. 24, 2021

(54) LUGGAGE PROTECTOR ASSEMBLY

(71) Applicant: Tracey Scott, Houston, TX (US)

(72) Inventor: Tracey Scott, Houston, TX (US)

( * ) Notice: Subject to any disclaimer, the term of this patent is extended or adjusted under 35 U.S.C. 154(b) by 339 days.

(21) Appl. No.: 16/115,079

(22) Filed: Aug. 28, 2018

(65) Prior Publication Data

US 2020/0069014 A1 Mar. 5, 2020

(51) Int. Cl.
*A45C 5/14* (2006.01)
*A45C 13/30* (2006.01)
*A45C 5/03* (2006.01)

(52) U.S. Cl.
CPC ..... *A45C 5/14* (2013.01); *A45C 5/03* (2013.01); *A45C 13/30* (2013.01); *A45C 2005/148* (2013.01)

(58) Field of Classification Search
CPC ... A45C 5/14; A45C 2005/248; A45C 13/002; A45C 13/30; A45C 2005/148
USPC ..... 190/18 R, 26, 102, 18 A
See application file for complete search history.

(56) References Cited

U.S. PATENT DOCUMENTS 1,197,190 A * 9/1916 Dunn et al. ..... A45C 5/146 280/47.35
1,731,547 A * 10/1929 Stansbury ..... A45C 13/36 190/115
2,647,595 A 8/1953 Meyers
2,711,234 A 6/1955 Rubens
3,901,360 A 8/1975 Cook
5,255,765 A * 10/1993 Schrecongost ..... A45C 13/002 150/154
5,351,792 A * 10/1994 Cohen ..... A45C 5/14 190/18 A
5,653,318 A * 8/1997 Field ..... 190/111
5,749,503 A 5/1998 Wulf et al.
6,742,684 B2 6/2004 Oh
7,441,641 B2 10/2008 Beakey
D705,541 S 5/2014 Harris
2011/0247910 A1* 10/2011 Darvish ..... A45C 13/385 190/18 A
2014/0166418 A1* 6/2014 Licciardino ..... A45C 13/002 190/18 A
2017/0215537 A1 8/2017 Yu

* cited by examiner

*Primary Examiner* — Sue A Weaver

(57) ABSTRACT

A luggage protector assembly includes an article of luggage that has a plurality of rollers thereon. A first enclosure is positionable on the article of luggage when the article of luggage is being loaded onto a vehicle for travel. The first enclosure surrounds respective ones of the rollers thereby protecting the respective rollers from is damaged. A pair of first straps is each wrapped over the article of luggage to retain the first enclosure on the article of luggage. A second enclosure is slidably coupled to the first enclosure. The second enclosure is positionable on the article of luggage when the article of luggage is being loaded onto a vehicle for travel. The second enclosure surrounds respective ones of the rollers thereby protecting the respective rollers from is damaged. A pair of second straps is each wrapped over the article of luggage to retain the article of luggage on the second enclosure.

9 Claims, 8 Drawing Sheets

LUGGAGE PROTECTOR ASSEMBLY

CROSS-REFERENCE TO RELATED APPLICATIONS

Statement Regarding Federally Sponsored Research or Development

Not Applicable

The Names of the Parties to a Joint Research Agreement

Not Applicable

Incorporation-by-Reference of Material Submitted on A Compact Disc or as a Text File Via the Office Electronic Filing System Not Applicable

Statement Regarding Prior Disclosures by the Inventor or Joint Inventor

Not Applicable

BACKGROUND OF THE INVENTION

(1) Field of the Invention

(2) Description of Related Art Including Information Disclosed Under 37 CFR 1.97 and 1.98

The disclosure and prior art relates to protector devices and more particularly pertains to a new protector device for PURPOSE.

BRIEF SUMMARY OF THE INVENTION

An embodiment of the disclosure meets the needs presented above by generally comprising an article of luggage that has a plurality of rollers thereon. A first enclosure is positionable on the article of luggage when the article of luggage is being loaded onto a vehicle for travel. The first enclosure surrounds respective ones of the rollers thereby protecting the respective rollers from is damaged. A pair of first straps is each wrapped over the article of luggage to retain the first enclosure on the article of luggage. A second enclosure is slidably coupled to the first enclosure. The second enclosure is positionable on the article of luggage when the article of luggage is being loaded onto a vehicle for travel. The second enclosure surrounds respective ones of the rollers thereby protecting the respective rollers from is damaged. A pair of second straps is each wrapped over the article of luggage to retain the article of luggage on the second enclosure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
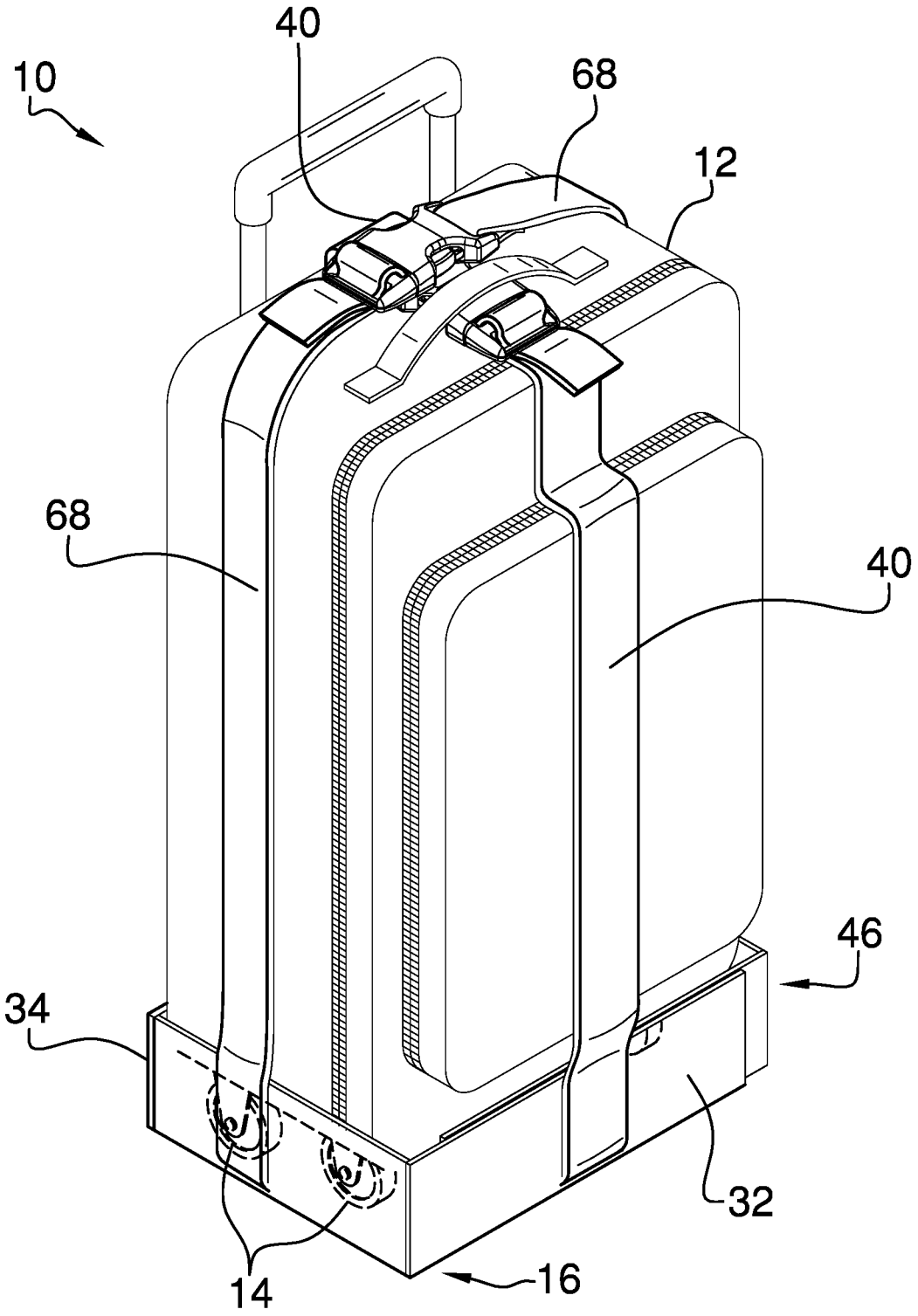
FIG. 1 is a top perspective view of a luggage protector assembly according to an embodiment of the disclosure.
Figure 2:
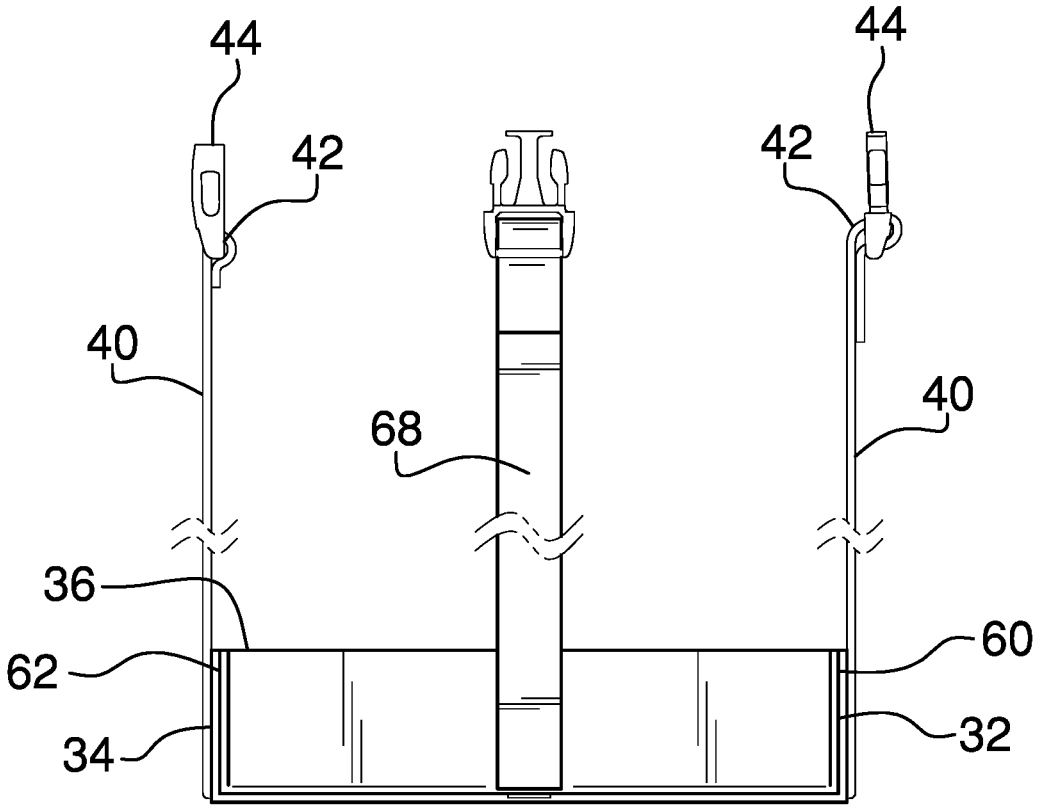
FIG. 2 is a right side view of a first and second enclosure of an embodiment of the disclosure.
Figure 3:
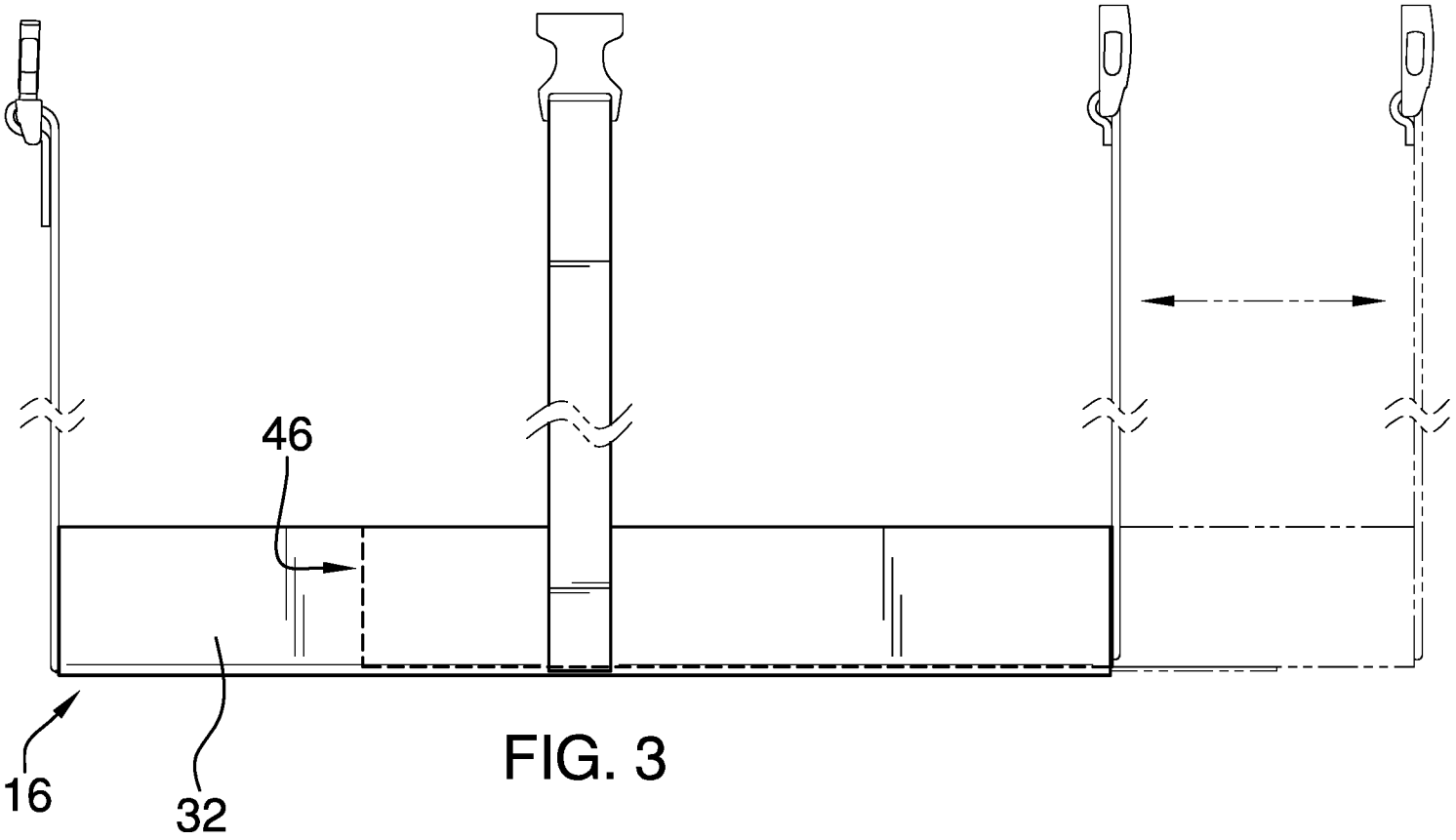
FIG. 3 is a front phantom view of a first and second enclosure of an embodiment of the disclosure.
Figure 4:
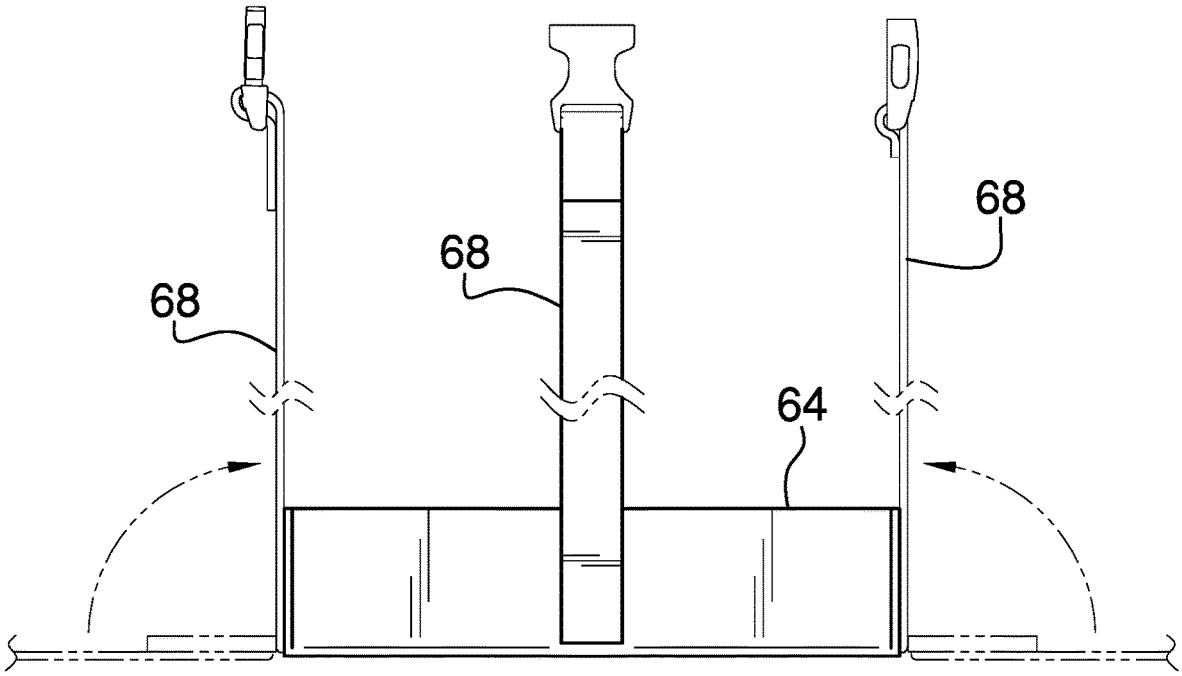
FIG. 4 is a left side phantom view of a first and second enclosure of an embodiment of the disclosure.
Figure 5:
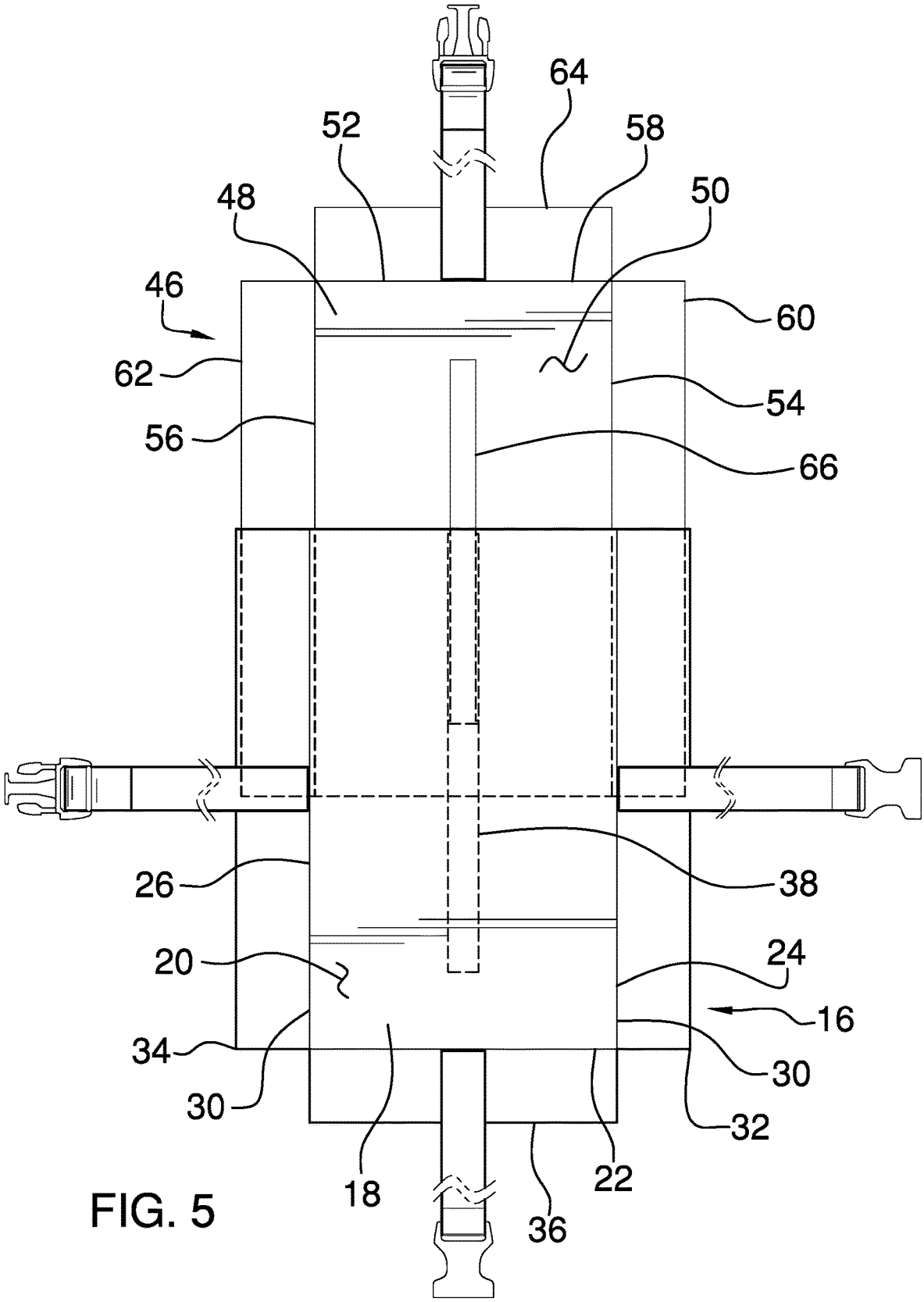
FIG. 5 is a bottom phantom view of a first and second enclosure of an embodiment of the disclosure.
Figure 6:
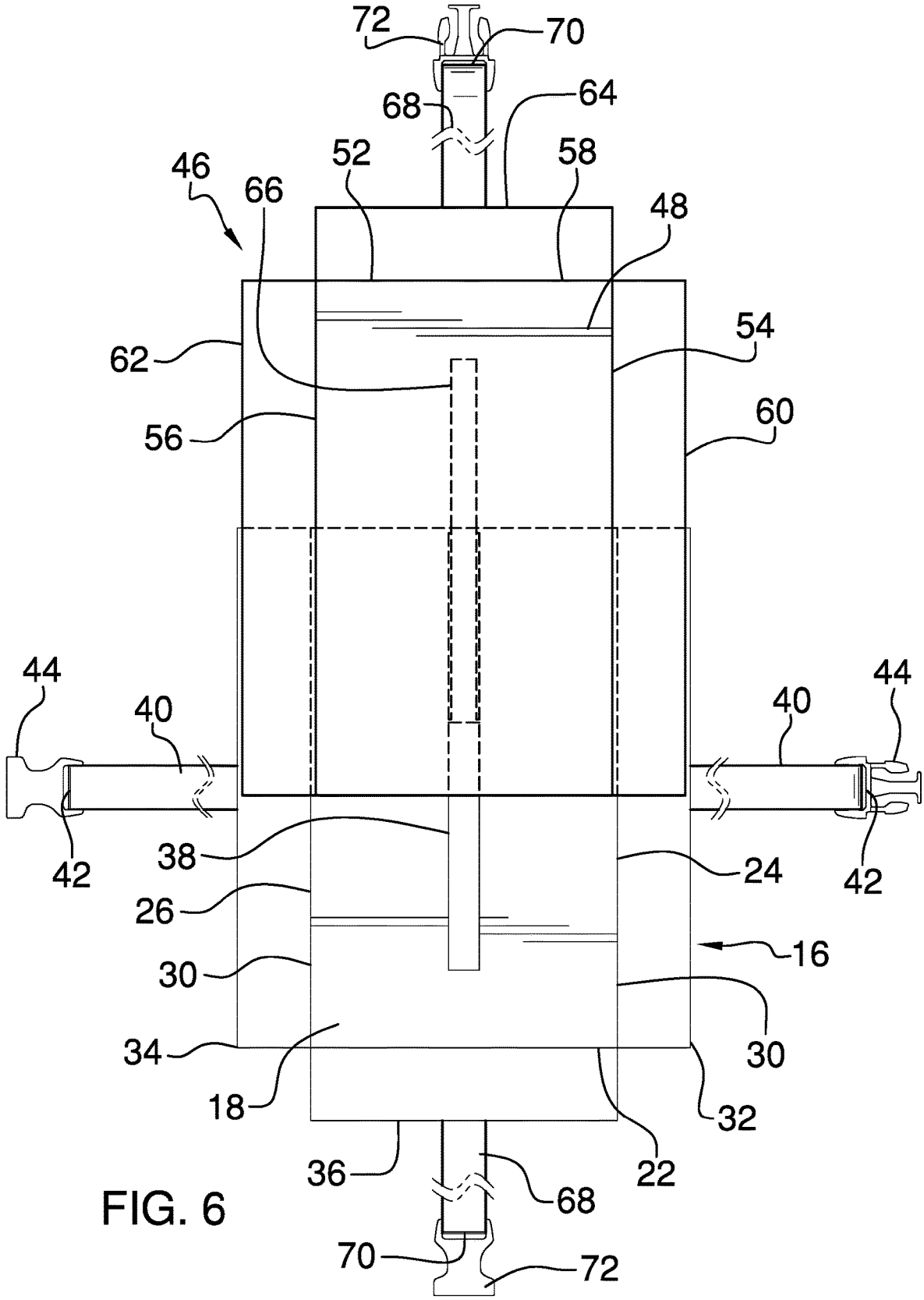
FIG. 6 is a top phantom view of a first and second enclosure of an embodiment of the disclosure being expanded.
Figure 7:
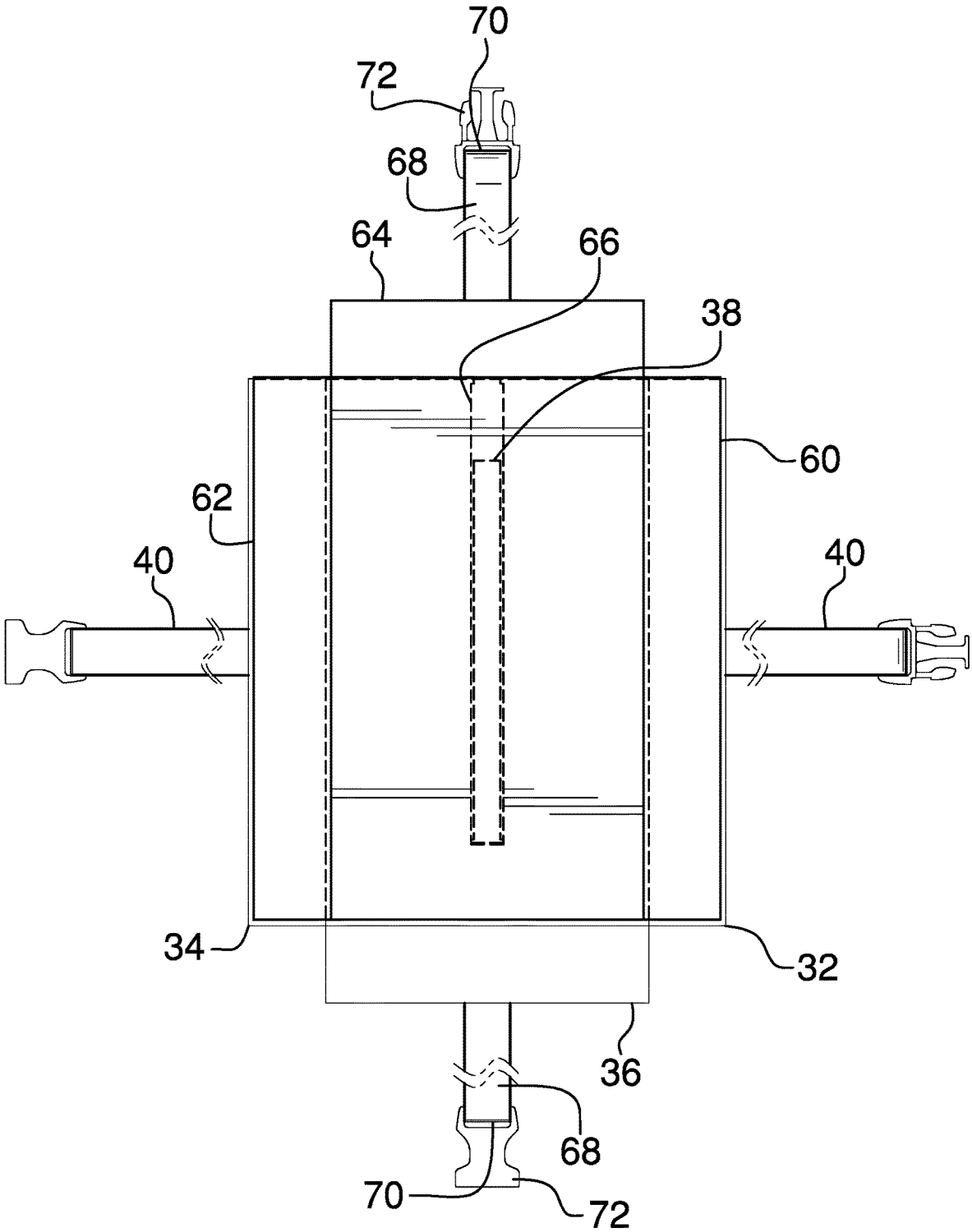
FIG. 7 is a top phantom view of a first and second enclosure of an embodiment of the disclosure being compressed.

With reference now to the drawings, and in particular to FIGS. 1 through 8 thereof, a new protector device embodying the principles and concepts of an embodiment of the disclosure and generally designated by the reference numeral 10 will be described.

As best illustrated in FIGS. 1 through 8, the luggage protector assembly 10 generally comprises an article of luggage 12 that has a plurality of rollers 14 thereon. The article of luggage 12 may be a suitcase or the like and the rollers 14 may be casters or any other roller commonly found on luggage 12. A first enclosure 16 is positionable on the article of luggage 12 when the article of luggage 12 is being loaded onto a vehicle, such as an airplane or a bus, for travel. The first enclosure 16 is comprised of a rigid material and the first enclosure 16 surrounds respective ones of the rollers 14 thereby protecting the respective rollers 14 from being damaged.

The first enclosure 16 comprises a first panel 18 that has a top surface 20 and a perimeter edge 22, and the perimeter edge 22 has a front side 24, a back side 26 and a first lateral side 28. A pair of hinges 30 is each coupled to the perimeter edge 22 and each of the hinges 30 is positioned on and is coextensive with a respective one of the front 24 and back 26 sides. A front flap 32 is coupled to the hinge 30 on the front side 24 such that the front flap 32 is hingedly coupled to the first panel 18 and the front flap 32 is coextensive with the front side 24. A back flap 34 is coupled to the hinge 30 on the back side 26 such that the back flap 34 is hingedly coupled to the first panel 18 and the back flap 34 is coextensive with the back side 26.

A side flap 36 is bendably coupled to the first lateral side 28 and the side flap 36 is coextensive with the first lateral side 28. Each of the front 32, back 34 and side 36 flaps extend upwardly from the first panel 18 when the front 32, back 34 and side 36 flaps are positioned in a deployed position. Alternatively, each of the front 32, back 34 and side 36 flaps lies on the first panel 18 when each of the front 32, back 34 and side 36 flaps are positioned in a stored position.

A first track 38 is coupled to the top surface 20 of the first panel 18 and the first track 38 is oriented to be collinear with the front 24 and back 26 sides. Additionally, the first track 38 is centrally positioned on the first panel 18. A pair of first straps 40 is each coupled to the first enclosure 16. Each of the first straps 40 is wrapped over the article of luggage 12 when the article of luggage 12 is positioned on the first enclosure 16 for retaining the first enclosure 16 on the article of luggage 12. Each of the first straps 40 has a distal end 42 with respect to the first enclosure 16 and each of the first straps 40 is positioned on a respective one of the front 32 and back 34 flaps. A pair of first mating members 44 is each coupled to the distal end 42 of a respective one of the first straps 40. The first mating members 44 are matable together to secure article of luggage 12 on the first panel 18 and each of the first mating members 44 may comprise a buckle or other type of releasable fastener.

A second enclosure 46 is provided and the second enclosure 46 is slidably coupled to the first enclosure 16. The second enclosure 46 is positionable on the article of luggage 12 when the article of luggage 12 is being loaded onto the vehicle for travel. The second enclosure 46 is comprised of a rigid material and the second enclosure 46 surrounds respective ones of the rollers 14 thereby protecting the respective rollers 14 from being damaged. The second enclosure 46 comprises a second panel 48 that has a lower surface 50 and a peripheral edge 52, and the peripheral edge 52 has a forward side 54, a rear side 56 and a second lateral side 58.

A forward flap 60 is bendably coupled to the forward side 54 and the forward flap 60 is coextensive with the forward side 54. A rear flap 62 is bendably coupled to the rear side 56 and the rear flap 62 is coextensive with the rear side 56. A lateral flap 64 is bendably coupled to the second lateral side 58 and the lateral flap 64 is coextensive with the second lateral side 58. Each of the forward 60, rear 62 and lateral 64 flaps extends upwardly from the second panel 48 when the forward 60, rear 62 and lateral 64 flaps are positioned in a deployed position. The forward flap 60 is positioned between the article of luggage 12 and the front flap 32 when the forward 60 and front 32 flaps are in the deployed position. Additionally, the rear flap 62 is positioned between the article of luggage 12 and the back flap 34 when the rear 62 and back 34 flaps are in the deployed position.

A second track 66 is coupled to the lower surface 50 of the second panel 48 and the second track 66 is oriented to be collinear with the forward 54 and rear 56 sides. The second track 66 slidably engages the first track 38 such that the second panel 48 is slidably coupled to the second panel 48. Thus, the second lateral side 58 of the peripheral edge 52 of the second panel 48 is spaceable a selected distance from the first lateral side 28 of the perimeter edge 22 of the first panel 18. In this way the first 16 and second 46 enclosures can accommodate articles of luggage 12 with a variety of widths.

A pair of second straps 68 is each coupled to a respective one of the first 16 and second 46 enclosures and each of the second straps 68 is positioned on a respective one of the side 36 and lateral 64 flaps. Each of the second straps 68 is wrapped over the article of luggage 12 when the article of luggage 12 is positioned on the first 16 and second 46 enclosures. Each of the second straps 68 has a distal end 70 with respect to the second enclosure 46. A pair of second mating members 72 is each coupled to the distal end 70 of a respective one of the second straps 68. The second mating members 72 are matable together to secure the article of luggage 12 on the second enclosure 46. Each of the second mating members 72 may comprise a buckle or other releasable fastener.

In use, the first enclosure 16 is slid on the second enclosure 46 to space the side flap 36 a selected distance from the lateral flap 64 to accommodate the width of the article of luggage 12. The rollers 14 on the article of luggage 12 are positioned on top of the first 18 and second 48 panels and each of the front, forward, back, rear, side and lateral flap 64*s* are folded upwardly on the article of luggage 12. Each of the first straps 40 is wrapped over the article of luggage 12 and the first mating members 44 are mated together. Each of the second straps 68 is wrapped over the article of luggage 12 and the second mating members 72 are mated together. In this way each of the first 16 and second 46 enclosures are retained on the article of luggage 12 to protect the rollers 14 from being damaged. Thus, the rollers 14 are protected from being broken off or otherwise damage when the article of luggage 12 is loaded onto an aircraft by baggage handlers or the like.

Figure 8:
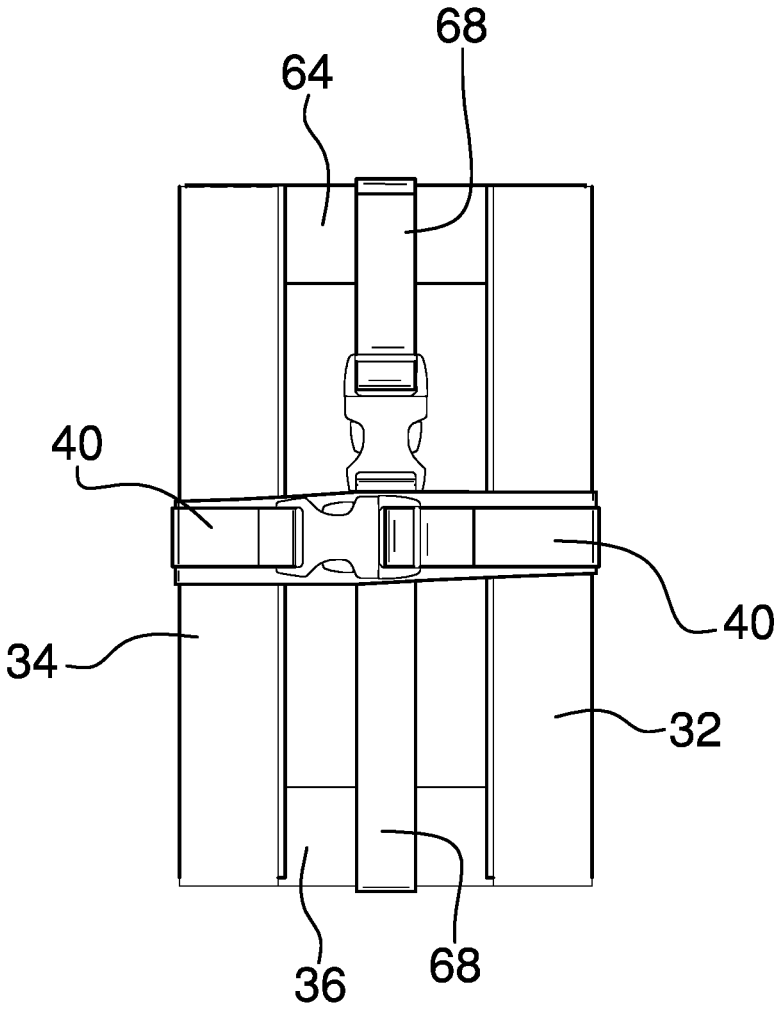
FIG. 8 is a top view of a first and second enclosure an embodiment of the disclosure being folded for storage.

Each of the first 40 and second 68 straps is removed from the article of luggage 12 when traveling is finished and the article of luggage 12 is removed from the first 16 and second 46 enclosures. Thus, the luggage 12 can be rolled on the rollers 14 for transporting the luggage 12 along a support surface. As shown in FIG. 8, each of the front 32, forward 60, back 34, rear 62, side 36 and lateral 64 flaps are folded inwardly onto the first 16 and second 48 panels for storage. Moreover, each of the first 40 and second 68 straps is coupled together on top of each of the front 32, forward 60, back 34, rear 62, side 36 and lateral 64 flaps for storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A luggage protector assembly being configured to protect rollers on luggage from being damaged during travel, said assembly comprising:

an article of luggage having a plurality of rollers thereon;

a first enclosure being positionable on said article of luggage when said article of luggage is being loaded onto a vehicle for travel, said first enclosure being comprised of a rigid material, said first enclosure surrounding respective ones of said rollers thereby protecting said respective rollers from being damaged;

a pair of first straps, each of said first straps being coupled to said first enclosure, each of said first straps being wrapped over said article of luggage when said article of luggage is positioned on said first enclosure to retaining said first enclosure on said article of luggage;

a second enclosure being slidably coupled to said first enclosure, said second enclosure being positionable on said article of luggage when said article of luggage is being loaded onto a vehicle for travel, said second enclosure being comprised of a rigid material, said second enclosure surrounding respective ones of said rollers thereby protecting said respective rollers from being damaged; and a pair of second straps, each of said second straps being coupled to a respective one of said first and second enclosures, each of said second straps being wrapped over said article of luggage when said article of luggage is positioned on said first and second enclosures.

2. The assembly according to claim 1, wherein:

said first enclosure comprises a first panel having a top surface and a perimeter edge, said perimeter edge having a front side, a back side and a first lateral side; and a pair of hinges, each of said hinges being coupled to said perimeter edge, each of said hinges being positioned on and being coextensive with a respective one of said front and back sides.

3. The assembly according to claim 2, further comprising a front flap being coupled to said hinge on said front side such that said front flap is hingedly coupled to said first panel, said front flap being coextensive with said front side;

a back flap being coupled to said hinge on said back side such that said back flap is hingedly coupled to said first panel, said back flap being coextensive with said back side; and a side flap being bendably coupled to said first lateral side, said side flap being coextensive with said first lateral side, each of said front, back and side flaps extending upwardly from said panel when said front, back and side flaps are positioned in a deployed position.

4. The assembly according to claim 3, further comprising a first track being coupled to said top surface of said panel, said first track being oriented to be collinear with said front and back sides.

5. The assembly according to claim 4, wherein said second enclosure comprises:

a second panel having an upper surface and a perimeter edge, said perimeter edge having a forward side, a rear side and a second lateral side;

a forward flap being bendably coupled to said forward side, said forward flap being coextensive with said forward side;

a rear flap being bendably coupled to said rear side, said rear flap being coextensive with said rear side; and a lateral flap being bendably coupled to said second lateral side, said lateral flap being coextensive with said second lateral side.

6. The assembly according to claim 5, wherein each of said forward, rear and lateral flaps extends upwardly from said panel of said second enclosure when said forward, rear and lateral flaps are positioned in a deployed position having said forward flap being positioned between said article of luggage and said front flap and having said rear flap being positioned between said article of luggage and said back flap.

7. The assembly according to claim 5, further comprising a second track being coupled to said lower surface of said second panel, said second track being oriented to be collinear with said forward and rear sides, said second track slidably engaging said first track such that said second panel is slidably coupled to said first panel.

8. The assembly according to claim 7, wherein said second lateral side of perimeter edge of said second panel is spaceable a selected distance from said first lateral side of said peripheral edge of said first panel thereby facilitating said first and second enclosures to accommodate articles of luggage having a variety of widths.

9. A luggage protector assembly being configured to protect rollers on luggage from being damaged during travel, said assembly comprising:

an article of luggage having a plurality of rollers thereon;

a first enclosure being positionable on said article of luggage when said article of luggage is being loaded onto a vehicle for travel, said first enclosure being comprised of a rigid material, said first enclosure surrounding respective ones of said rollers thereby protecting said respective rollers from being damaged, said first enclosure comprising:

a first panel having a top surface and a perimeter edge, said perimeter edge having a front side, a back side and a first lateral side;

a pair of hinges, each of said hinges being coupled to said perimeter edge, each of said hinges being positioned on and being coextensive with a respective one of said front and back sides;

a front flap being coupled to said hinge on said front side such that said front flap is hingedly coupled to said first panel, said front flap being coextensive with said front side;

a back flap being coupled to said hinge on said back side such that said back flap is hingedly coupled to said first panel, said back flap being coextensive with said back side;

a side flap being bendably coupled to said first lateral side, said side flap being coextensive with said first lateral side, each of said front, back and side flaps extending upwardly from said panel when said front, back and side flaps are positioned in a deployed position; and a first track being coupled to said top surface of said panel, said first track being oriented to be collinear with said front and back sides;

a pair of first straps, each of said first straps being coupled to said first enclosure, each of said first straps being wrapped over said article of luggage when said article of luggage is positioned on said first enclosure to retaining said first enclosure on said article of luggage, said first straps being matable to each other, each of said first straps being positioned on a respective one of said front and back flaps;

a second enclosure being slidably coupled to said first enclosure, said second enclosure being positionable on said article of luggage when said article of luggage is being loaded onto a vehicle for travel, said second enclosure being comprised of a rigid material, said second enclosure surrounding respective ones of said rollers thereby protecting said respective rollers from being damaged, said second enclosure comprising:

a second panel having a lower surface and a perimeter edge, said perimeter edge having a forward side, a rear side and a second lateral side;

a forward flap being bendably coupled to said forward side, said forward flap being coextensive with said forward side;

a rear flap being bendably coupled to said rear side, said rear flap being coextensive with said rear side;

a lateral flap being bendably coupled to said second lateral side, said lateral flap being coextensive with said second lateral side, each of said forward, rear and lateral flaps extending upwardly from said panel of said second enclosure when said forward, rear and lateral flaps are positioned in a deployed position having said forward flap being positioned between said article of luggage and said front flap and having said rear flap being positioned between said article of luggage and said back flap; and a second track being coupled to said lower surface of said second panel, said second track being oriented to be collinear with said forward and rear sides, said second track slidably engaging said first track such that said second panel is slidably coupled to said first panel, said second lateral side of perimeter edge of said second panel being spaceable a selected distance from said first lateral side of said peripheral edge of said first panel thereby facilitating said first and second enclosures to accommodate articles of luggage having a variety of widths; and a pair of second straps, each of said second straps being coupled to a respective one of said first and second enclosures, each of said second straps being wrapped over said article of luggage when said article of luggage is positioned on said first and second enclosures, said second straps being matable to each other, each of said second straps being positioned on a respective one of said side and lateral flaps.

* * * * *